United States Patent [19]

Littman

[11] 3,950,904

[45] Apr. 20, 1976

[54] SHUTTER FASTENING DEVICE

[75] Inventor: Bruce A. Littman, Highland Park, Ill.

[73] Assignee: Benson Mfg. Corporation, Menomonee Falls, Wis.

[22] Filed: Nov. 25, 1974

[21] Appl. No.: 526,884

[52] U.S. Cl. ..... 52/105; 52/507; 52/511; 52/512; 52/473; 52/713; 248/225

[51] Int. Cl.[2] ..... E06B 7/08

[58] Field of Search ..... 52/473, 511, 512, 507, 52/506, 544, 546, 551, 385, 386, 359, 712, 105, 713; 248/225

[56] References Cited

UNITED STATES PATENTS

| | | | |
|---|---|---|---|
| 1,665,601 | 4/1928 | Mortimer | 52/105 |
| 2,094,188 | 9/1937 | Phelan | 52/551 |
| 2,528,910 | 11/1950 | Poe | 52/758 D |
| 2,653,686 | 9/1953 | Routt | 52/544 |
| 2,684,776 | 7/1954 | Rosenstein | 206/346 |
| 3,031,044 | 4/1962 | Stitt | 52/512 |
| 3,097,360 | 7/1963 | Carlson | 206/346 |
| 3,341,994 | 9/1967 | Olson | 52/105 |
| 3,727,361 | 4/1973 | Greene | 52/473 |
| 3,741,385 | 6/1973 | Corey | 206/347 |
| 3,828,925 | 8/1974 | Magyar | 206/347 |
| 3,868,803 | 3/1975 | Bice | 52/473 |

*Primary Examiner*—John E. Murtagh
*Assistant Examiner*—Henry Raduazo
*Attorney, Agent, or Firm*—Henry C. Fuller

[57] ABSTRACT

Two U-shaped clamps which are adapted to be fastened to spaced-apart mounting channels on the rear of a shutter are joined together by a pliable spacer strip which extends between the clamps and spaces them a predetermined distance apart to match the distance between the spaced channels. The spacer strip enables the clamps to be attached to a building wall in position to support the shutter without the necessity of measuring the distance between the clamps. The pliability of the spacer strip enables the clamps and the attached spacer strip to be conveniently carried in a pocket prior to installation. The spacer strip preferably extends beyond the side edge of the clamps to serve as a gauge to locate the shutter a selected distance from the window frame side.

4 Claims, 3 Drawing Figures

SHUTTER FASTENING DEVICE

BACKGROUND OF THE INVENTION

This invention is an improvement in the shutter mounting clamp disclosed in U.S. patent application Ser. No. 366,882, filed on June 4, 1973, now U.S. Pat. No. 3,868,803. This patent discloses a plastic shutter which has a pair of spaced-apart vertical mounting channels attached to its rear side portions. The shutter is attached to a building wall beside a window frame by means of U-shaped clamps which are nailed to the wall in position to engage the mounting channels and hold the shutter in the desired position relative to the window. These prior art mounting clamps perform their intended function, but they are relatively difficult to install because their position must be carefully measured relative to the window frame and relative to each other so that they will match the spacing of the mounting channels on the shutter and will hold the shutter in the correct spacing and alignment relative to the window frame.

SUMMARY OF THE INVENTION

The shutter fastening device of this invention eliminates the necessity of measuring the spacing between the fastening elements. A pliable spacing strip attached between the clamps spaces the clamps the correct distance apart for a given plastic shutter. The pliability of the spacing strip enables the fastening elements and the attached spacing strip to be conveniently carried in a pocket prior to installation. Preferably, the spacing strip extends past at least one fastening element by the correct spacing between the window frame and the nearest fastening element so as to eliminate the necessity of that measurement also. The pliable spacing strip is preferably transparent so that the portion which extends beyond the side edges of the shutter will not be visible except at close range.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figure 2:
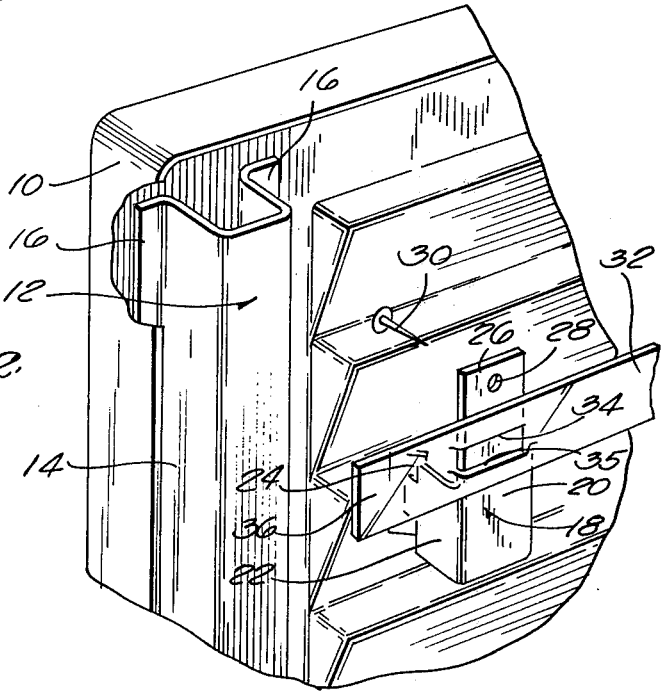
FIG. 2 is a fragmentary exploded perspective rear view of one rear corner of the preferred shutter fastening device and one rear corner of a plastic shutter fitted with a mounting channel for attachment to the shutter fastening device.
Figure 3:
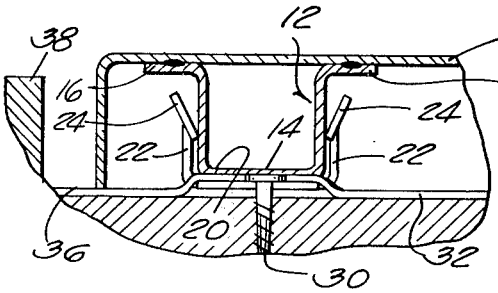
FIG. 3 is a fragmentary cross-sectional view taken through a corner of a plastic shutter showing one mounting channel thereof engaged by the preferred fastening element of this invention.

The shutter fastening device of this invention is adapted for use in combination with a plastic shutter 10 having two elongated hat-shaped mounting channels 12 fastened to the rear side portions thereof as shown in FIGS. 2 and 3. Although only one mounting channel 12 is shown in the drawings, it will be understood that a similar mounting channel 12 is attached to the other side of shutter 10 in spaced-apart parallel relationship with the illustrated mounting channel 12. Each mounting channel 12 has a substantially rectangular rib portion 14 and two outturned flanges 16 which are sonically welded or otherwise secured to the rear of plastic shutter 10. Mounting channels 12 extend substantially the full length of shutter 10 and can be gripped at any desired position along their length to fasten shutter 10 to a building wall.

In the preferred embodiment, U-shaped clamps 18 are used as the fastening element for gripping the rib portion of mounting channels 12. Each clamp 18 has a flat web portion 20 and two spaced-apart legs 22. The terminal portions of legs 22 diverge outwardly and include barbs 24 which are directed rearwardly and are adapted to grip the sides of mounting channels 10 to hold shutter 10 in place. The web portion 20 of clamps 18 extend longitudinally beyond legs 22 at 26 and have an aperture 28 (FIG. 2) for receiving screws 30 or other fasteners to secure clamps 18 to a building wall.

Plastic shutter 10, mounting channels 12, and clamps 18 are substantially similar to the corresponding elements disclosed in the above-noted U.S. patent.

Figure 1:
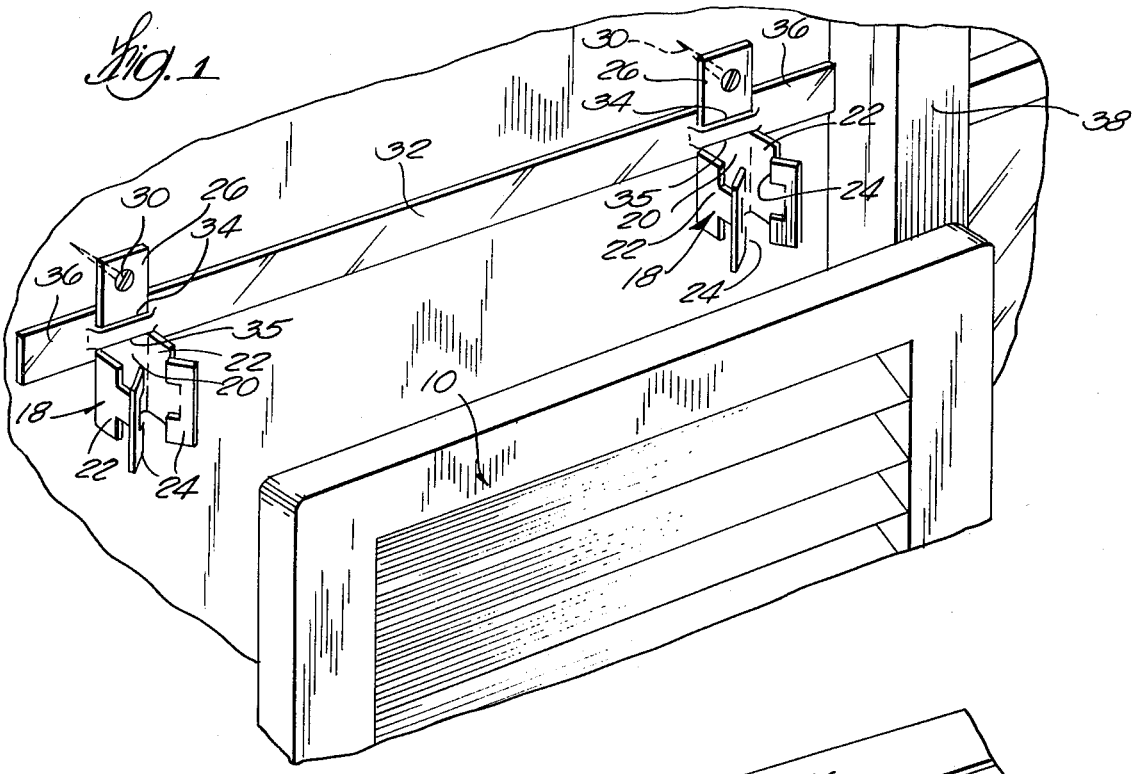
FIG. 1 is a fragmentary perspective view of the preferred fastening device of this invention attached to a building wall adjacent a window frame, the upper front portion of a plastic shutter being shown spaced in front of the shutter fastening device in position to be engaged therewith.

The novel feature of this embodiment comprises a pliable spacing strip 32 which is slotted at 34 and 35 to receive the extended portions 26 of clamps 18 and to hold clamps 18 spaced apart by the same spacing as that of mounting channels 12. The pliability of spacing strip 32 enables strip 32 and the attached clamps 18 to be carried over a shoulder or in a pocket or pouch prior to installation. Spacing strip 32 can be made of any suitable plastic such as polyethylene or the like, and is preferably extended past clamps 18 at 36 by a distance equal to the desired spacing between the edge of a window frame 38 (FIGS. 1 and 3) and the nearest clamp 18 to space the shutters at the desired distance from the window frame. With extended portion 36, all measurements are eliminated from the installation procedure for shutter 10. Strip 32 and the attached clamps 18 are merely held up to the building wall at the desired height opposite window frame 38 with extended strip portion 36 abutting against window frame 38. Clamps 18 are then screwed or nailed to the building wall at the spacing determined by spacing strip 32 and are in the proper position for receiving mounting channels 12 as shown in FIG. 3 to fasten shutter 10 to the wall at the proper spacing from the edge of window frame 38.

Pliable spacing strip 32 is preferably made of transparent or translucent material so that the portions 36 which extend past the side edges of shutter 10 will not be visible except at close range.

It should be understood that this invention is not limited to use in combination with U-shaped clamps 18 and hat-shaped mounting channels 12. Other fastening elements could be used if desired. For example, clamps 18 could be replaced by hooked fasteners which are adapted to engage spaced slots in the back of shutters 10. Other modifications of the disclosed embodiment will be apparent to those skilled in the art and this invention includes all modifications that fall within the scope of the following claims.

Although the invention discloses use of the strip with the specific clamps and channels shown in U.S. Pat. No. 3,868,803, other clamps or fastening arrangements can be employed which are within the purview of the invention.

What is claimed is:

1. A fastening device for securing a shutter to a building wall adjacent to a window frame, comprising two fastening elements adapted to be secured to two spaced apart fastening portions on the rear of said shutter, and a pliable plastic spacer strip attached at opposite ends to said fastening elements and extending therebetween to space the fastening elements at a predetermined distance from each other to match the distance between said shutter fastening portions, said spacer strip being sufficiently pliable to permit said strip to be carried in a pocket prior to installation, said spacer strip having extended portions which extend past said fastening elements by a distance equal to the desired spacing between the edge of the window frame and the edge of the shutter to afford uniform spacing of shutters from window frames, without the necessity of measuring the distance from the window frame to the nearest fastening element.

2. The fastening device of claim 1 wherein said spacer strip is made of substantially transparent material.

3. The fastening device of claim 1 wherein each fastening element includes a flat vertically-extending portion, and wherein said spacer strip is slotted at opposing ends to receive said vertically-extending portions, and adjacent ends of said slots being spaced apart by the desired spacing for said fastening elements.

4. The fastening device of claim 1 wherein said shutter fastening portions comprise longitudinally-extending ribs which are substantially rectangular in cross-sectional shape, and wherein said fastening elements comprise U-shaped clamps adapted to grip said ribs to support said shutter.

* * * * *